US005147065A

United States Patent [19]

Rush et al.

[11] Patent Number: 5,147,065

[45] Date of Patent: Sep. 15, 1992

[54] DISPOSABLE CUP LID HAVING A TEAR-RESISTANT STRAW SLOT

[75] Inventors: Jonathan E. Rush, Phillipsburg, N.J.; Robert J. Linnander, Nazareth, Pa.

[73] Assignee: James River Corporation of Virginia, Richmond, Va.

[21] Appl. No.: 787,639

[22] Filed: Nov. 4, 1991

[51] Int. Cl.[5] ..... B65D 51/00

[52] U.S. Cl. ..... 220/709; 220/229; 220/266; 215/1 A; 215/229

[58] Field of Search ..... 220/229, 266, 709; 215/1 A, 229, 253; 229/103.1

[56] References Cited

U.S. PATENT DOCUMENTS

| | | | |
|---|---|---|---|
| 3,822,030 | 7/1974 | Tanzer | 220/709 |
| 4,074,827 | 2/1978 | Labe, III . | |
| 4,106,660 | 8/1978 | Boyle | 220/266 X |
| 4,245,752 | 1/1981 | Prueher | 220/266 |
| 4,350,260 | 9/1982 | Prueher | 220/254 |
| 4,438,865 | 3/1984 | Scattaregia | 220/270 |
| 4,441,623 | 4/1984 | Antoniak . | |
| 4,502,608 | 3/1985 | Mills . | |
| 4,811,860 | 3/1989 | Sorenson et al. | 220/380 |
| 4,901,881 | 2/1990 | McElroy | 220/287 |
| 4,948,009 | 8/1990 | Sawatani | 220/229 |
| 4,999,230 | 3/1991 | Pipkins | 428/43 |
| 5,025,947 | 6/1991 | Leone | 220/709 X |

*Primary Examiner*—Stephen Marcus
*Assistant Examiner*—Nova Stucker
*Attorney, Agent, or Firm*—Sixbey, Friedman, Leedom & Ferguson

[57] ABSTRACT

A disposable cup lid has intersecting straw insertion slits and rip-stop end cuts located transversely to and spaced from the ends of the straw insertion slits. In a preferred embodiment, the rip-stop end cuts are stamped lines of weakness or perforations, located perpendicularly to, and between about 1/32 and 1/16 inch beyond, the ends of the straw insertion slits. In another preferred embodiment, the end cuts are portions of the arc of a circle with a diameter slightly larger than the length of the straw insertion slits. The rip-stop end cuts, together with the straw insertion slits, define frangible reinforcing webs connecting wedge-shaped lid portions defined by the straw insertion slits. The webs strengthen the cup during shipment, during mounting on the cup, and during transportation of the filled cup prior to insertion of the straw. The webs are broken by insertion of the straw, resulting in a structure that effectively prevents the force of straw insertion from tearing the top surface of the lid.

18 Claims, 3 Drawing Sheets

DISPOSABLE CUP LID HAVING A TEAR-RESISTANT STRAW SLOT

BACKGROUND OF THE INVENTION

The present invention relates to an improvement in a disposable straw-insertable lid for drinking cups. Disposable plastic straw-insertable lids are well known, and are found in environments where beverages are vended, dispensed or sold for consumption, such as at fast food restaurants. The straw-insert opening facilitates the insertion of a straw into the cup without eliminating the protection provided by the lid against spillage of the cup's contents.

Typically, a straw insert opening comprises two perpendicularly crossing "straw insertion slits" in the lid body. The straw insertion slits may be lines of weakness or may be complete perforations in the lid. The slits create a pattern in the lid of four adjacent wedge-shaped sections with their apexes at a common center point. A drinking straw is pressed against the center point, causing the wedge-shaped sections to be displaced inwardly, thus allowing the straw to pass through the lid and into the cup.

Conventional straw-insertable lids are subject to ripping, which occurs when the application of force during the insertion of a straw actually tears the lid rather than merely displacing the wedge-shaped sections defined by the lines of weakness. Typically, ripping occurs at the ends of the straw insertion slits and extends across the lid in the direction of the straw-insertion slits.

Major consumers of these lids, such as fast-food restaurant chains, demand that the tendency of the lids to rip be minimized. This requirement in the market exists for several reasons. First, ripping of the lid on insertion of the straw is undesirable in that it provides an enlarged opening through which liquid will flow if the cup is tipped, jostled, or overturned. Second, this type of ripping may produce a jagged edge which is sharp and therefore poses a safety hazard. Finally, ripping changes the geometry of the straw insertion slits so that the straw may not be located with its central longitudinal axis at the intersection of the straw insertion slits. When the straw is correctly located, the forces applied to the straw by the wedge-shaped portions of the lid are uniform forces and thus do not tend to crush the straw, but are resisted by the straw's uniform cross section. Mislocation of the straw as a result of ripping results in uneven forces tending to crush the straw and prevent the passage of liquid through the straw. This tendency of the ripped lid to crush the straw is particularly undesirable when a thicker beverage such as a milkshake is being consumed through the straw, since the crushing of the straw may effectively prevent suction of the milkshake through the straw.

The amount of ripping experienced varies with the type of plastic used in the cup lid; more flexible plastics (i.e. having a greater rubber content) such as K-resin crystal tend to rip less than more brittle or rigid plastics, such as high-impact polystyrene. Plastics such as high-impact polystyrene can be produced at lower cost, so it would be desirable to develop a lid design that would not rip even when constructed from high-impact polystyrene.

An example of a known lid constructed to reduce ripping of this type is shown generally in FIG. 1. As shown in FIG. 1, lid 101 has a rim 102 which engages a cup rim (not shown). Straw insertion slit 103 comprises lines of weakness or through-slits 104 and 105, which are formed in relatively perpendicular fashion in the lid by stamping or molding. Transverse rip-stop end cuts 106 formed continuously with and perpendicular to the ends of through-slits 104 and 105 tend to reduce the extension of rips or tears past the ends of the through-slits. Stamping of numerous lines of weakness in the lid, as performed in designs of this type, results in a weakening of the planar structure of the lid in the region of the straw-hole. This weakness may result in cracking of the lids during packing and bulk shipment, and also in much less effective sealing of liquids inside the cup.

Another example of a prior art drinking lid device is disclosed in U.S. Pat. No. 4,948,009 to Sawatani, which shows a lid with a protruding outer ring which surrounds the otherwise conventional through-slits. The ring is said to stop fractures starting at an end of a through-slit. Designs of this type have the disadvantage of requiring more material than planar lids. Because these lids are produced in tremendous volumes, the need for even a small amount of additional material in each lid becomes undesirable.

Yet another type of straw-insertable drinking lid is shown in U.S. Pat. No. 4,245,752 and 4,350,260 to Prueher and U.S. Pat. No. 4,438,865 to Scattaregia. These references show holes provided at the ends of the intersecting through-slits which could perform a tear-reducing function. Of course, designs of this general type are less effective in keeping liquids inside the cup since liquids can pass through the holes.

U.S. Pat. No. 4,502,608 to Mills discloses a disposable lid for a drinking cup in which a cut is made though the thickness of the lid. The cut functions to terminate the tearing-out of a wedge-shaped piece as it is removed from the cup lid to permit drinking from the cup. U.S. Patent No. 4,999,230 to Pipkins discloses a sheet with removable sections defined by a series of arcuate cuts which are separated by connection points. The connection points are broken to remove the sections from the sheet.

As noted, known designs for disposable cup lid have not been entirely satisfactory. What is needed is a lid that could be manufactured from lower-cost, more brittle plastic, which would effectively hold in liquids prior to insertion of a straw, and which would not fracture in an undesirable manner during shipment, placement on the cup, or upon insertion of a straw. At the same time, an ideal design could be produced without requiring additional material or additional production operations, either of which would make the improved lid more expensive than known lids.

SUMMARY OF THE INVENTION

Accordingly, it is an object of the present invention to provide a novel straw-insertable disposable lid which provides improved protection against cracking or tearing beyond the through-slits caused by packing and shipping, placement of the lid on a cup, or the insertion of a drinking straw into the lid.

It is a further object of the present invention to provide an improved straw-insertable lid which protects against spillage of the container's contents both before and after the straw has been inserted.

Another object of the present invention is to provide an improved straw-insertable lid which can be produced at the same cost as conventional disposable lids containing through-slits.

Yet another object of the invention is to provide an improved straw-insertable lid made from high-impact polystyrene or similar plastic which does not exhibit undesirable fracturing upon straw insertion.

A further object of the present invention is to provide a straw-insertable lid which has improved tear-resistance but can be produced using the same amount of material as a conventional lid without additional production steps.

These and other objects of the present invention are achieved by providing a disposable cup lid with rip-stop end cuts spaced from and transverse to straw insertion slits provided in the lid. In a preferred embodiment, the rip-stop end cuts are stamped lines of weakness or perforations, located perpendicularly to and about 1/32 inch to 1/16 inch beyond the ends of the through-slits. In another preferred embodiment, the end cuts are portions of the arc of a circle with a diameter slightly larger than the length of the straw insertion slits. The rip-stop end cuts, together with the straw insertion slits, define frangible reinforcing webs connecting wedge-shaped lid portions defined by the straw insertion slits. The webs strengthen the cup during shipment, during mounting on the cup, and during transportation of the filled cup prior to insertion of the straw. The webs are broken by insertion of the straw to produce a structure that effectively prevents the force of straw insertion from tearing the top surface of the lid.

Cracking or tearing usually originates at the end of one or more straw insertion slits and moves outwardly in a radial direction. Location of the rip-stops at the ends of the through-slits according to the present invention blocks the cracking or tearing. The gaps provide physical connection between the wedge-shaped areas defined by the slits, increasing the structural strength of the lid. Thus, the gaps provide additional resistance to tearing of the plastic lid which accompanies the insertion of a drinking straw into the straw insertion slits.

BRIEF DESCRIPTION OF THE DRAWINGS

The features and objects of the present invention will be described in greater detail hereafter, in association with the accompanying drawings in which.

DETAILED DESCRIPTION OF THE PREFERRED EMBODIMENT

Figure 2:
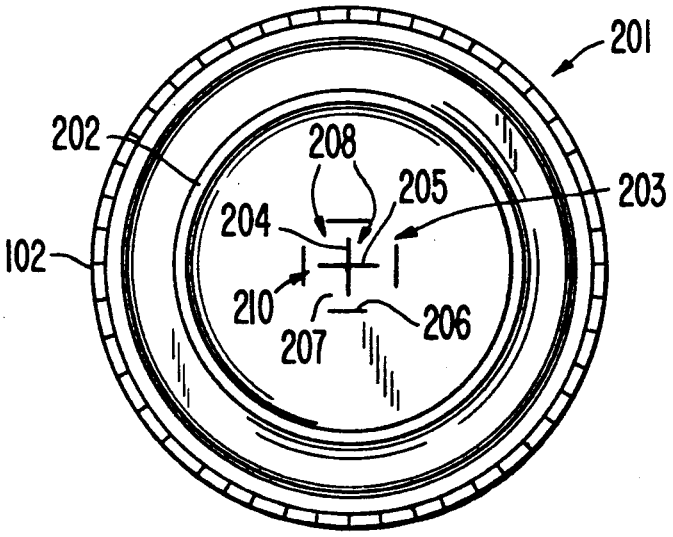
FIG. 2 is a top plan view of a preferred embodiment of the present invention.

A preferred embodiment of the present cup lid is shown generally at 201 in FIG. 2. Disposable lid 201 is made of plastic and is designed for use with a conventional drinking cup, not shown. Lid 201 includes a conventional rim 102 designed to engage an opening of the cup to hold lid 201 firmly on the cup. Rim 102 surrounds a disk-like body 202 which covers the cup opening when lid 201 is installed on the cup.

Body 202 has a straw slot opening 203 which functions as a means for facilitating the insertion of a drinking straw (not shown) into the cup for withdrawing liquid by suction. The straw slot opening 203 comprises two mutually perpendicular through-slits 204 and 205. Through-slits 204 and 205 cross at their midpoints at right angles, thus being mutually bisecting. Through-slits 204 and 205 will be sized according to the size of straw to be used, and may typically each be about ⅝" in overall length. These through-slits 204 and 205 are situated so as to form a pattern of four adjacent wedge-shaped sections 208 which are typically displaced inwardly during the insertion of the straw into the straw slot opening 203.

Located at the ends of the two through-slits 204 and 205 of straw slot opening 203 are four rip-stop end cuts 206. A gap 207 is present between the through-slits 204 and 205 and the end cuts 206, so that end cuts 206 are spaced from the through-slits 204 and 205. In the preferred embodiment, the gap 207 is about 1/32" to 1/16". However, a larger or smaller gap could be provided to achieve different strength and straw insertion characteristics.

The various wedge-shaped sections 208 are connected by the material present in gaps 207, thus forming frangible reinforcing webs 210 which provide greater structural strength in the body 202 during bulk shipment of lids 201, installation of a lid 201 on a filled cup, and transportation of the filled cup prior to insertion of the straw.

Rip-stop end cuts 206 may be constructed by a stamping operation, or may be molded into the plastic of lid 201. Preferably, rip-stop end cuts 206 are formed at the same time as the straw slot opening 203 in a single stamping operation. Rip-stop end cuts 206 may be lines of weakness where the material of lid 201 is made thinner or more brittle, or the rip-stop end cuts 206 may be formed as actual perforations in the body 202 of lid 201. Rip-stop end cuts 206 are oriented in a transverse configuration from the ends of the through-slits 204 and 205. That is, each end cut 206 crosses an imaginary line incorporating one of the through-slits 204 or 205, at a point on the imaginary line beyond through-slit 204 or 205, respectively. The end cuts 206 are bisected by this imaginary line.

The four rip-stop end cuts 206 provide a means of protecting against extended fracture cracking or tearing of the through-slits 204 and 205 which may be caused by the insertion of a drinking straw into lid 201. Specifically, when a straw is inserted into through-slits 204 and 205, the connection of the wedge-shaped sections 208 by frangible reinforcing webs 210 in the area of gaps 207 will apply a momentary counteracting force to center the straw in the through-slits 204 and 205. If the force used to insert the straw is excessive, so that the lid 201 is ripped, initial tearing will be directed along the through-slits 204 and 205 and along the line thereof into the area of gap 207 to break the frangible reinforcing webs 210, resulting in a structure which directs and absorbs tearing forces to prevent extended tears across the body 202. Much of this momentary excessive force will be absorbed by the ripping of the small amount of material in gap 207, i.e. the frangible reinforcing web 210. When the web 210 is fractured and the tears thus reach one or more end cuts 206, end cuts 206 will tend to redirect the tear transversely to through-slits 204 and 205 so that any continuation of the tear will be in a transverse direction about the straw insertion area, rather than toward rim 102 of lid 201. Also, when the tear reaches the end cuts 206, the opening up of end cuts 206 will tend to permit greater flexing of lid 201 in the area, thus releasing the stresses imposed on the material of lid 201 by insertion of the straw and reducing the amount of overall tearing. Generally, the combination of the force absorbed in ripping of the frangible reinforcing webs 210 and the force absorbed by flexure of the lid 201 due to the opening of end cuts 206 will be sufficient to prevent further ripping of lid 201 and the undesirable characteristics associated with this ripping. Thus, in contrast to other known designs, the present invention is designed to rip in a controlled manner through frangible reinforcing webs 210 during straw insertion, rather than being designed to avoid ripping altogether. The present design therefore provides a convertible structure. During packing and shipping of lids 201 and mounting on a filled cup, the lid 201 will have superior structural strength provided by frangible reinforcing webs 210. During insertion of the straw, frangible reinforcing webs 210 are broken, resulting in a more flexible, tear-controlling structure wherein through-slits 204 and 205 are connected to end cuts 206.

Figure 3:
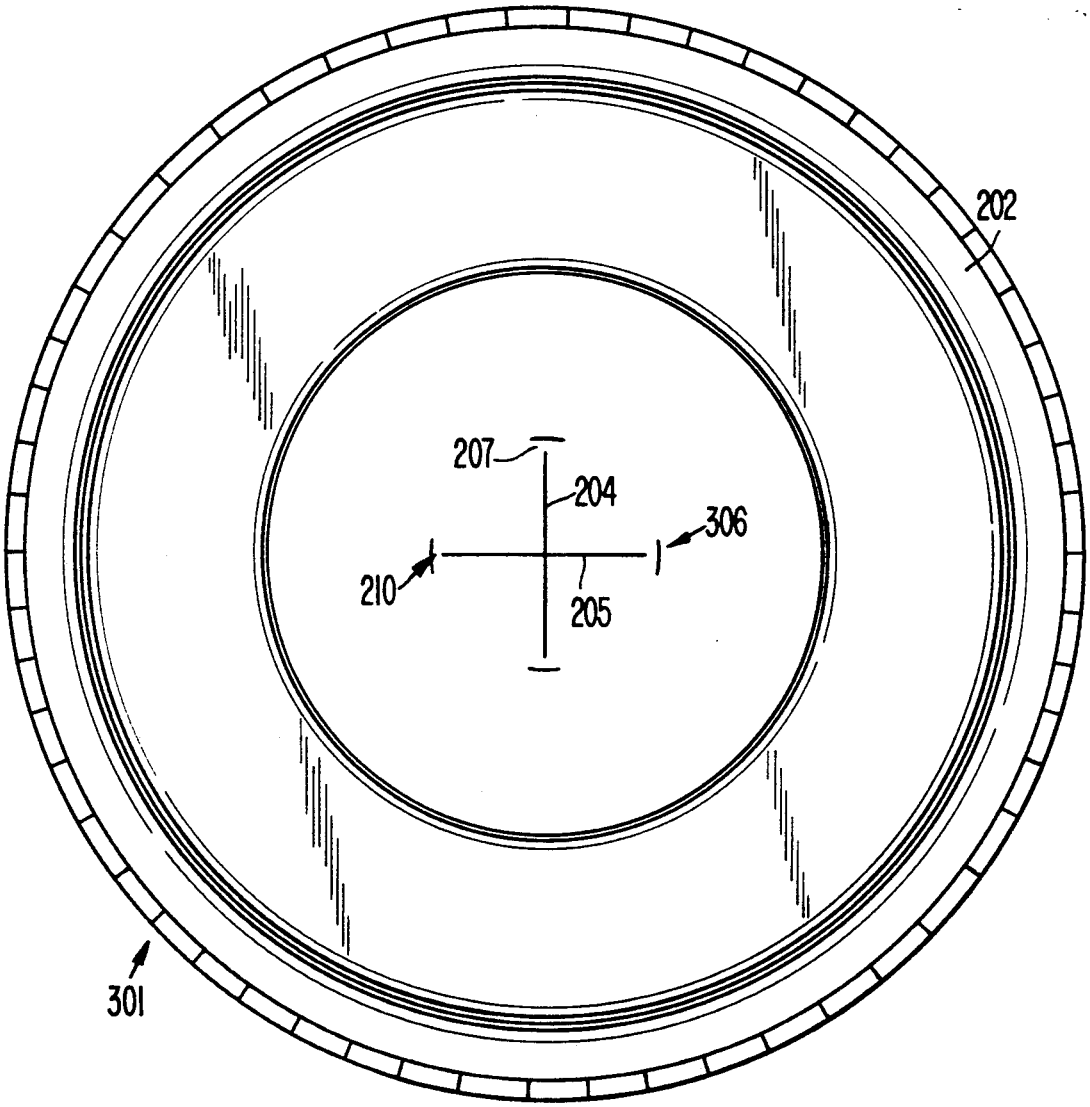
FIG. 3 is a top plan view of another preferred embodiment of the present invention.

FIG. 3 shows a lid 301 functioning in a similar manner and embodying another preferred variation of the present invention in which end cuts 306 have an arcuate shape. Specifically, in the embodiment of FIG. 3, end cuts 306 are portions of arc of an imaginary circle with its center at the intersection of through-slits 204 and 205, and a diameter slightly larger than the length of through-slits 204 and 205, so that end cuts 306 are spaced from the ends of through-slits 204 and 205 by gap 207. End cuts 306 preferably each comprise 15 degrees of arc of the imaginary circle, bisected by an imaginary line extending from through-slits 204 and 205, respectively. The arcuate construction of end cuts 306 in this embodiment tends to direct very large fractures, which may cause a tear at an end of one of the end cuts 306, in a direction around the imaginary circle, so that the fractures remain in the area of the straw and relieve pressure thereon. Thus, in this embodiment, the tendency of any extended fractures to extend from the ends of end cuts 306 across the body 202 of lid 301 will be even further reduced as compared to the embodiment of FIG. 2.

An important advantage of the design of FIGS. 2 and 3 is the increased structural strength realized prior to insertion of the straw. This increased structural strength results from the connection of wedge-shaped sections 208 in the area of gaps 207 by frangible reinforcing webs 210.

This structural reinforcement provided by frangible reinforcing webs 210 results in improved performance during packing and bulk shipment of lids 201 or 301. When relatively more brittle plastics such as high-impact polystyrene are used to form lids 201 or 301, packing and shipping operations can result in cracking in the central planar area of weakness in body 202 created by the provision of straw slot opening 203. Frangible reinforcing webs 210 add structural reinforcement to the central region of body 202 of lid 201 and 301 during packing and shipping, but the frangible nature of the webs 210 still permits rip-stop end cuts 206 or 306 to function in the desired manner upon insertion of a straw in the lid 201 or 301, respectively.

Figure 1:
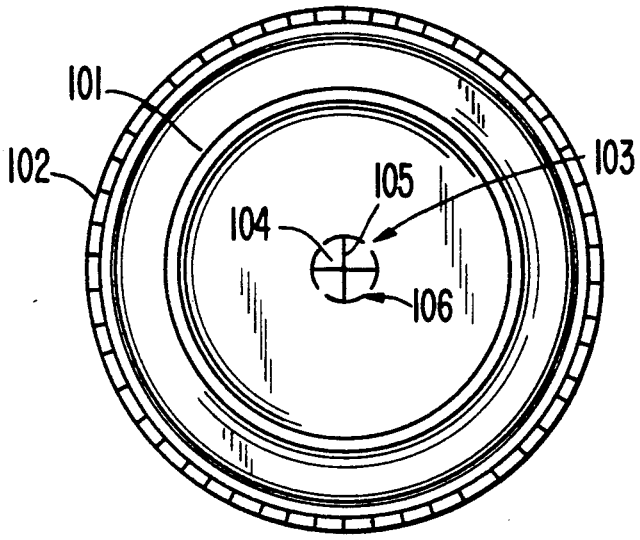
FIG. 1 (PRIOR ART)
FIG. 1 is a top plan view of a known lid.

The reinforcement also prevents the wedge-shaped sections 208 from swinging outward under fluid pressure in the event the cup is overturned in a "transportation phase" of cup use, after the lid is mounted on the cup but before the straw has been inserted. Typically, in a fast-food restaurant, drinks are provided at the service counter with lids installed and carried on a tray to a seating area or passed to an automobile, where the straw is inserted and the drink is consumed. If a cup is overturned during this transportation phase, it is desired that no liquid escape through the yet-unused straw hole. Thus, the present design, which provides a straw hole with no apertures, and with greater closed strength and resistance to fluid pressure, has substantial advantages over the design of FIG. 1 and other known designs in that it better resists the outward flow of fluids prior to insertion of the straw.

Thus, the controlled ripping design of the present invention, with its frangible reinforcing webs 210 tending to hold straw slot opening 203 in a sealed position, provides improved structural strength prior to straw insertion, yet permits insertion of the straw without ripping across body 202 of lid 201 or 301.

Figure 4:
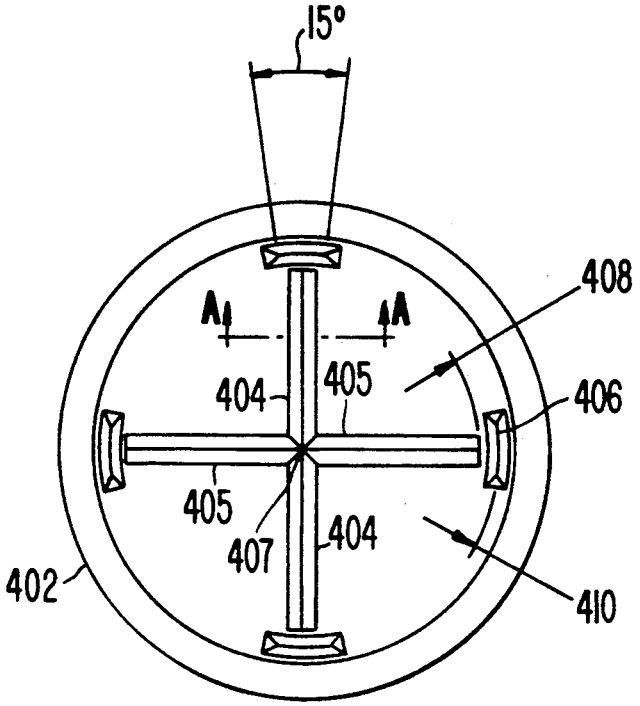
FIG. 4 is a top view of a punch perforator useful in constructing the lid of the present invention.

As noted previously, rip-stop end cuts 206 are preferably constructed in a single stamping operation at the time of formation of straw slot opening 203. FIG. 4 shows a punch 402 which may be used to stamp the lid of FIG. 3. This punch is used with a matching die and otherwise conventional equipment in a lid punching operation such as is conventionally performed to make straw insertion slots in plastic disposable cup lids. Punch 402 may be constructed from a standard punch blank such as a BP 75×2.00 A2 punch blank sold by Danly Machine Corp. of Chicago, Ill.

Punch 402 has projections 404 designed to form through-slits 204 (shown in lid 301 of FIG. 3). Projections 405 will form the through-slits 205, similarly shown in lid 301 of FIG. 3. Projections 406 form the rip-stop end cuts 306 shown in FIG. 3. Punch 402 is generally circular, with a center 407. Dimensions of the punch for a preferred embodiment will be given, although the dimensions may be varied as desired to produce larger or smaller slots. In the preferred embodiment, projections 404 and 405 extend 0.312 inches between center 407 and a circle with radius 408 of 0.312 inches. Four projections 406 are located equidistantly about a circle with center 407 and radius 410 of, for example, 0.343 inches. Projections 406 have arcuate cutting portions lying on the circle having center 407 and radius 410, with each projection 406 projecting along 15 degrees of arc of this circle. Each projection 406 is centered with respect to projections 404 and 405 so that each projection 406 is bisected by a ray extending from center 407 toward the projection 406 along the center of a proximate one of projections 404 and 405.

The difference between the dimensions of radius 408 and radius 410, approximately 1/32" in the preferred embodiment, will determine the width of frangible reinforcing webs 210, and these dimensions may be varied as desired to produce either wider or more narrow reinforcing webs 210.

Figure 5:
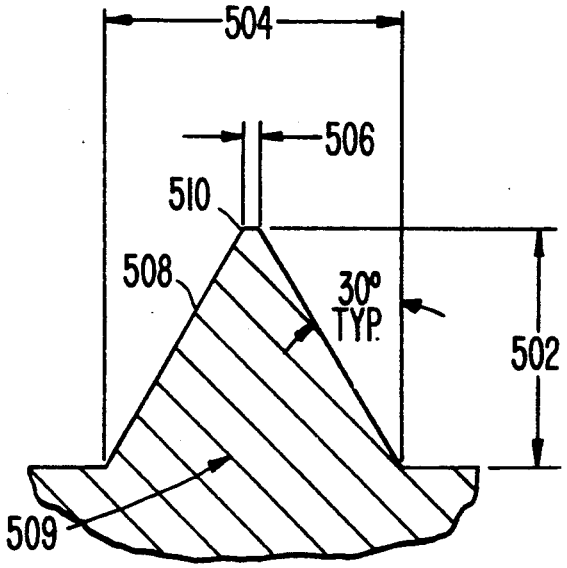
FIG. 5 is a cross-sectional view along line A-A of the punch of FIG. 4.

FIG. 5 is a cross-sectional view of the punch of FIG. 4 showing the cross-sectional configuration of projections 404, 405, and 406 thereof. In the preferred embodiment, the projections will have a generally parallelogram-shaped cross section with a base 509, cutting edge 510, and sides 508. The cross section has a height 502 of 0.040 inches, a base width 504 of 0.048 inches, and a top or cutting edge width 506 of 0.002 to 0.003 inches. The sides 508 of the projections will slope between the base 509 and the cutting edge 510 at approximately 30 degrees from the vertical, as shown. As can be seen with reference again to FIG. 4, not only the sides but also the ends of projections 404, 405, and 406 will be angled in this manner at 30 degrees from the vertical between cutting edge 510 and base 509.

Empirical test data comparing lids constructed according to the present invention with other lid designs demonstrates the reduction in tearing of the through-slits 204 and 205 provided by the present invention. In the test, forces were applied to a sample of lids to simulate the forces experienced upon insertion of a drinking straw. The results of this test showed that only 8% of the lids according to the present invention cracked, compared to a cracking (failure) rate of 11% for the design shown in FIG. 1. The failure rate of a straw slot with no transverse line of weakness such as end cuts 206 or 306 was found to be 20%. Thus, the lid according to the present invention provides a substantial improvement in strength and functionality over conventional straw-slot lids and also over the commercially available lid design shown in FIG. 1.

We claim:

1. A straw-insertable lid for a drinking cup comprising;

a flexible disk-like body having a top surface;

a plurality of intersecting lines of weakness each extending between two ends, said lines of weakness located on the body and adapted to permit the insertion of a drinking straw through said top surface and thus into the drinking cup;

wherein the body is further provided with tear-stopping lines of weakness transverse to said intersecting lines of weakness, and spaced from the ends thereof.

2. The lid of claim 1 wherein said tear-stopping lines of weakness are spaced between about 1/32" and about 1/16" from said ends of said intersecting lines of weakness.

3. The lid of claim 1 wherein there are two perpendicularly intersecting lines of weakness and there are four tear-stopping lines of weakness, of which two are perpendicular to each of said intersecting lines of weakness.

4. The lid of claim 1 wherein there are two perpendicularly intersecting lines of weakness and there are four tear-stopping lines of weakness, the tear-stopping lines of weakness being of arcuate form.

5. The lid of claim 4 wherein the four tear-stopping lines of weakness are portions of a single circle.

6. The lid of claim 5 wherein each tear-stopping line of weakness comprises about 15 degrees of arc of said circle.

7. A straw-insertable lid for a drinking cup comprising;

flexible disk means for covering an opening of the cup and having a top surface;

straw receiving means located on the flexible disk means comprising a plurality of intersecting lines of weakness each extending between two ends, for permitting the insertion of a drinking straw through said top surface and thus into the drinking cup;

tear-stopping means comprising transverse lines of weakness transverse to said intersecting lines of weakness of the straw receiving means, and spaced from the ends thereof.

8. The lid of claim 7 wherein said transverse lines of weakness are spaced between about 1/32" and about 1/16" from said ends of said intersecting lines of weakness.

9. The lid of claim 7 wherein there are two said intersecting lines of weakness intersecting perpendicularly and there are four said transverse lines of weakness, of which two are perpendicular to and bisected by a line including each of said intersecting lines of weakness.

10. The lid of claim 7 wherein there are two perpendicularly intersecting lines of weakness and there are four said transverse lines of weakness, said transverse lines of weakness being of arcuate form.

11. The lid of claim 10 wherein the four arcuate transverse lines of weakness lie on a circle.

12. The lid of claim 11 wherein each transverse line of weakness comprises about 15 degrees of arc of said circle.

13. A straw-insertable lid for a drinking cup comprising;

flexible disk means for covering an opening of the cup and having a top surface;

straw receiving means located on the flexible disk means comprising a plurality of intersecting lines of weakness each extending between two ends, for permitting the insertion of a drinking straw through said top surface and thus into the drinking cup; and tear-stopping means comprising directional lines of weakness in said flexible disk means for directing the path of fractures in said flexible disk means, said directional lines of weakness being spaced from the ends of said intersecting lines of weakness by reinforcing means;

said reinforcing means for maintaining said intersecting lines of weakness in a closed position prior to said insertion of said straw, said reinforcing means being frangible upon said insertion of said straw to permit connection of said intersecting lines of weakness with said directional lines of weakness.

14. The lid of claim 13 wherein said directional lines of weakness are spaced between about 1/32" and about 1/16" from said ends of said intersecting lines of weakness and said reinforcing means is an uncut portion of material lying between said intersecting lines of weakness and said directional lines of weakness.

15. The lid of claim 13 wherein there are two said intersecting lines of weakness intersecting perpendicularly and there are four said directional lines of weakness, of which two are perpendicular to each of said intersecting lines of weakness.

16. The lid of claim 13 wherein there are two perpendicularly intersecting lines of weakness and there are four said directional lines of weakness, said directional lines of weakness being of arcuate form.

17. The lid of claim 16 wherein the four directional lines of weakness are portions of a single circle.

18. The lid of claim 17 wherein each directional line of weakness has its length along about 15 degrees of arc of said circle.

* * * * *